United States Patent [19]

Snow et al.

[11] Patent Number: 4,597,995

[45] Date of Patent: Jul. 1, 1986

[54] HIGH SPEED PIPE LINING METHOD AND APPARATUS

[75] Inventors: William E. Snow; Thomas R. Warren, both of Birmingham, Ala.

[73] Assignee: American Cast Iron Pipe Company, Birmingham, Ala.

[21] Appl. No.: 717,730

[22] Filed: Mar. 29, 1985

[51] Int. Cl.[4] ..... B05D 7/22; B05C 11/12; B05C 13/00; B05C 13/02

[52] U.S. Cl. ..... 427/231; 118/55; 118/57; 427/234

[58] Field of Search ..... 427/231, 234; 118/55, 118/57

[56] References Cited

U.S. PATENT DOCUMENTS

| | | | |
|---|---|---|---|
| 1,676,815 | 3/1926 | Beatty | 427/231 X |
| 2,161,968 | 6/1939 | Lyons et al. | 91/42 |
| 2,262,184 | 11/1941 | Ireton, Jr. | 22/88 |
| 2,336,946 | 12/1948 | Marden et al. | 117/18 |
| 2,641,218 | 6/1953 | Burwell | 118/55 |
| 2,792,807 | 5/1957 | Cummings | 118/72 |
| 2,873,716 | 2/1959 | Daniel et al. | 118/55 |
| 3,039,888 | 6/1962 | Sejournet et al. | 117/18 |
| 3,056,692 | 10/1962 | Kitada | 117/5.3 |
| 3,098,764 | 7/1963 | Kao et al. | 118/55 |
| 3,260,611 | 2/1963 | Weidenhammer et al. | 117/18 |
| 3,304,909 | 2/1967 | Hart et al. | 118/103 |
| 3,414,425 | 12/1968 | Gerlovich | 117/18 |
| 3,563,791 | 2/1971 | Janco | 117/95 |
| 3,601,085 | 8/1971 | Lemelson | 118/6 |
| 3,662,709 | 5/1972 | Janco | 118/318 |
| 3,858,552 | 1/1975 | Takata et al. | 118/318 |
| 3,878,815 | 4/1975 | Gorius | 118/318 |
| 4,291,640 | 9/1981 | Payne et al. | 118/50.1 |
| 4,326,480 | 4/1982 | Glatt | 118/50 |

*Primary Examiner*—James R. Hoffman

*Attorney, Agent, or Firm*—Kerkam, Stowell, Kondracki & Clarke

[57] ABSTRACT

High speed pipe lining is accomplished by supporting a length of pipe to be lined between spindles in a lathe-type apparatus and rotating the pipe at a speed sufficient to afford a G-force of the order of 10–15 G's. A rather fluid concrete mixture comprising gap-graded sand is introduced into the interior of the rotating pipe using a cantilevered trough. The rotational speed of the pipe is then increased substantially to afford a force of the order of 35–50 G's, and the pipe is subjected to high amplitude axial vibrations for a period of time of the order of one minute or less. The resulting concrete lining is highly compacted, quite dense and hard, and has a smooth surface.

25 Claims, 5 Drawing Figures

HIGH SPEED PIPE LINING METHOD AND APPARATUS

BACKGROUND OF THE INVENTION

This invention relates generally to methods and apparatus for lining or coating the interior of hollow objects, and more particularly to the lining of cast iron pipe and the like with concrete.

It is common to apply concrete or similar corrosion-resistant linings to the interior surfaces of metal pipe to prevent corrosion and rusting and the undesirable contamination of water carried by the pipe. The most practical way to apply such linings is to use a centrifugal process in which lining material is introduced into the interior of a length of pipe, and the pipe is rotated about its longitudinal axis. The rotation causes the lining material to be spread over the interior surfaces and to be compacted to produce a relatively smooth coating on the interior surfaces.

Considerable difficulty is encountered, however, in providing satisfactory concrete linings in pipe, particularly in long sections, e.g., twenty feet, of large diameter, e.g., forty inches, pipe. This is due, in part, to the inability to rotate the pipe at a sufficiently high enough speed to produce good compaction of the concrete so that shrinkage is minimized and so that voids or other defects do not result. As the concrete cures, shrinkage may also cause the lining to separate partially from the interior surfaces and permit voids or stress concentrations to develop in the lining, rendering it easily broken. Typically, concrete is introduced into the pipe by a slinger while the pipe is stationary. This necessitates using a concrete mix which is rather thick and not very flowable, i.e, somewhat dry, so that the concrete will stick to the pipe wall. The pipe is then rotated for a short period of time at a speed high enough to smooth out the concrete but low enough to avoid removing excessive water from the concrete. If too much water is removed, the concrete will not cure properly and the resulting lining will be powdery.

Conventional centrifugal lining apparatus supports the pipe section on spaced pairs of rollers which engage the peripheral surface of the pipe and which are driven to impart rotation to the pipe. It is practically impossible, however, to produce pipe which is perfectly round and balanced. Any out-of-roundness will cause the center of mass of the pipe to deviate from the access of rotation, and as the pipe is rotated, forces are produced which tend to lift the pipe from the rollers. To maintain the pipe in contact with the rollers, it is necessary to exert a downward force on the top of the pipe, as by using holddown rollers. Even with holddown rollers, as the pipe speed increases, lateral vibration and motion of the pipe due to out-of-roundness may become quite large. If the vibration becomes excessive, it may wreck the apparatus, and, in any event, a point is quickly reached where the force necessary to hold the pipe on the rollers exceeds the rim strength of the pipe. In addition, the lateral vibrations and bouncing to which the pipe is subjected interferes with the ability of the concrete mixture to spread uniformly and smoothly over the interior surface of the pipe and is detrimental to the resulting lining. As a result, the maximum speed at which the pipe may be rotated is substantially less than that desired to produce good compaction of the concrete.

It is desirable to provide pipe lining apparatus and methods which avoid these and other disadvantages of known methods and apparatus, and it is to this end that the present invention is directed.

SUMMARY OF THE INVENTION

The invention affords high speed pipe lining methods and apparatus which enable pipe to be lined rapidly and efficiently and which produce linings which are smooth, uniform, highly compacted and substantially void and defect free. The linings produced are rugged and durable, and pipe lined in accordance with the invention may be immediately handled without the excessive care required in handling pipe lined by conventional methods and apparatus.

Briefly stated, in accordance with the invention, a length of pipe to be lined is supported at its ends by a mechanism formed to rotate about an axis corresponding to the longitudinal axis of the pipe. The pipe is first rotated at a low speed about its longitudinal axis while depositing within the interior of the pipe uniformly along its length a predetermined quantity of lining material, the speed being selected to be such that the lining material is spread evenly about the interior surface of the pipe. The rotational speed of the pipe is then increased to a substantially higher speed and the pipe is subjected to vibrations in a direction parallel to the longitudinal axis of the pipe so as to compact the lining material.

More specifically, the mechanism which supports and rotates the pipe may be a lathe-type mechanism comprising movable spindles which engage and resiliently support the ends of the pipe. The lining material may be deposited within the interior of the pipe by a trough inserted axially into one end of the pipe. The rotational speed of the pipe while the lining material is being deposited therein is preferably such as to afford a centrifugal force of the order of 10–15 G's. The trough is removed from the pipe, and the rotational speed is then increased so as to afford a force of the order of 35–50 G's. The longitudinal vibrations imparted to the pipe during its high speed rotation may be effected by a striker member supported on one of the spindles which is arranged to repetitively strike the end of the pipe supported by that spindle. After about 30–60 seconds of high speed rotation and vibration, the vibration is stopped and the pipe is allowed to slow to rest.

Preferably, the lining material is concrete which is formed with gap-graded sand. The sand may comprise approximately equal quantities of fine and coarse particles, the diameters of which may be in a proportion of the order of 8:1. The gap-graded sand enables a given fluidity in the concrete mixture to be achieved with less water than required with non-gap graded sand, and the substantially higher rotational speeds achievable with the invention produce good compaction of the concrete and afford a smooth lining surface. Furthermore, the high speed rotation removes a substantial percentage of the water from the concrete mixture, so that, although the mixture is rather fluid when it is introduced into the pipe, after rotation the concrete is fairly hard. The longitudinal vibrations imparted to the pipe during high speed rotation produce thorough mixing of the fine and coarse sand particles in the concrete, and cause the fine particles to fill the interstices between the coarse particles. This helps to eliminate any voids in the concrete and produces a denser, more compact lining.

Other features and advantages of the invention will become apparent from the description which follows.

DESCRIPTION OF THE PREFERRED EMBODIMENT

The invention is particularly well adapted for applying concrete linings to long sections of large diameter cast iron pipe and the like, and will be described in that context. However, as will become apparent, this is illustrative of only one utility of the invention. For example, the invention is also applicable to applying linings to other objects, as well as to centrifugal molding operations.

Figure 1:
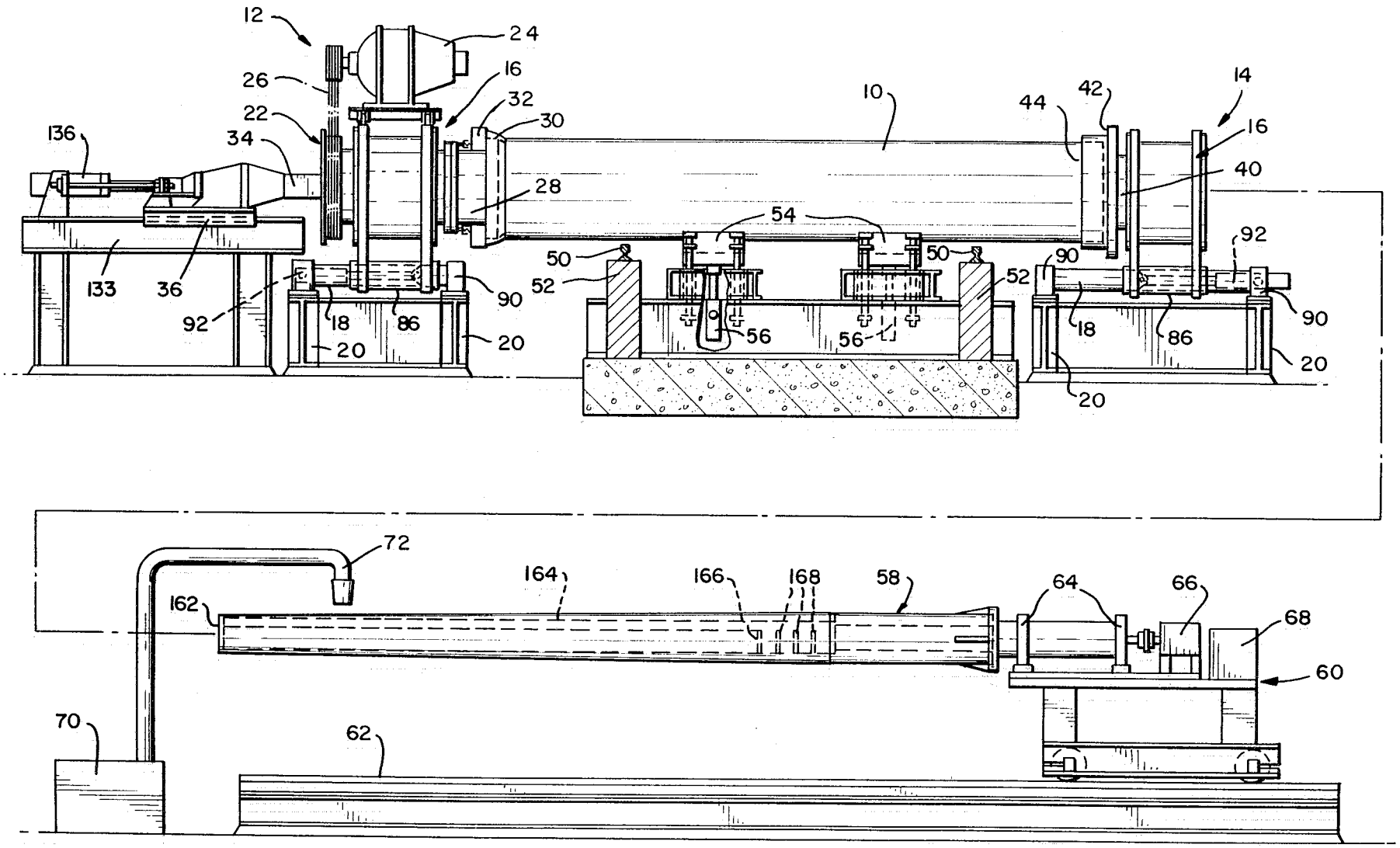
FIG. 1 is an elevational view, partially in cross section and partially broken away, of a high speed pipe lining apparatus in accordance with the invention.

FIG. 1 illustrates a high speed pipe lining apparatus in accordance with the invention for applying a lining to the interior of a length or section of pipe 10. As shown, the apparatus includes a lathe-type mechanism comprising a drive spindle arrangement 12 and a tail spindle arrangement 14 adapted to engage and support pipe 10 at its ends and to rotate the pipe about its longitudinal axis. Each spindle arrangement comprises a spindle frame 16 which is supported for movement in the axial direction of the pipe on guide shafts 18 which are mounted on a suitable support 20. Rotatably supported within the spindle frame of the drive spindle arrangement is a drive spindle 22 adapted to be rotated by a motor 24 and drive belts 26 about a longitudinal axis corresponding to the axis of the pipe. The drive spindle includes a spindle extension 28 which is formed to enter the bell or spigot end 30 of the pipe. The spindle extension carries a striker member 32 adapted to strike repetitively the bell end of the pipe to impart longitudinal vibrations to the pipe, the striker member being driven by a ram 34 mounted on a slide carriage 36, as will be described in more detail hereinafter.

The tail spindle frame similarly rotatably carries a tail spindle 40 which has a spigot end plate 42 adapted to simulate the bell end of a pipe section and to receive the tail end 44 of the pipe.

A section of pipe to be lined is rolled on a pair of spaced rails 50, which are supported on appropriate foundations 52 and extend normal to the longitudinal axis of the pipe (normal to the plane of the drawing), to a location between the head and the tail spindles. The pipe section may then be raised by a pair of V-shaped (in a plane transverse to the longitudinal axis) pipe lift devices 54 which are operated by an appropriate hydraulic, pneumatic or other actuating mechanism 56. The V-shaped pipe lifts center the pipe in the transverse direction (normal to the plane of the drawing) with respect to the spindles, and raise the pipe so that its longitudinal axis corresponds substantially to the longitudinal axis of the spindles. The spindle frames are then moved axially toward each other, in a manner to be described, so that the spindles engage the ends of the pipe. The pipe lifts are then lowered out of the way, leaving the pipe section supported on the spindles.

Concrete lining material may be introduced into the interior of the pipe section by inserting a cantilevered trough 58 into the interior of the pipe through the tail spindle 40. The trough may be carried on a movable trough car 60 which rides on tracks 62 that extend parallel to the longitudinal axis of the pipe. The trough is preferably rotatably supported on the trough car by appropriate rotary supports 64, and the trough may be connected to a rotary actuator 66 which rotates the trough about its longitudinal axis. Rotary actuator 66 may be a hydraulic actuator, for example, powered by a hydraulic power unit 68 carried on the trough car. The trough car may be driven back and forth along the tracks by an electric motor, for example, (not illustrated). The trough may be charged with a predetermined quantity of concrete lining material by pumping the concrete from a source 70 through a line 72 which discharges into the trough. The quantity of concrete loaded into the trough is calculated based upon the dimensions of the pipe to give a predetermined lining thickness, and the concrete is evenly distributed in the trough along the length of the trough.

As will be described in more detail shortly, upon a section of pipe being loaded into the spindles and the trough being charged with concrete, motor 24 is started to begin rotation of the drive spindle and the pipe, the tail spindle rotating by virtue of its engagement with the pipe, and the trough is inserted axially into the interior of the pipe. With the pipe rotating at a first, low, speed, sufficient to afford a centrifugal force of the order of 10–15 G's, for example, the trough is slowly rotated by actuator 66 to dump the concrete into the interior of the rotating pipe. The concrete, which is evenly distributed along the length of the trough, is dumped uniformly along the length of the pipe, and the centrifugal force causes the concrete to flow and spread uniformly over the interior surface. The trough is removed from the pipe and the rotational speed of the pipe is increased substantially to a second, high speed, sufficient to afford a force of the order of 35–50 G's, for example. While rotating at the higher speed, ram 34 is actuated to cause striker 32 rapidly and repetitively to strike the bell end of the pipe to produce longitudinal vibration of the pipe. High speed rotation and vibration is continued for a predetermined period of time such as thirty to sixty seconds, for example, after which the pipe is allowed to slow gradually to rest. The pipe lifts are then raised to support the pipe and allow the spindles to be retracted from the pipe ends, and the pipe is lowered onto the rails so that it may be rolled out of the way to make room for the next pipe section. The concrete lining is then preferably cured in a steam oven. This puts some of the moisture removed during high speed rotation back into the concrete, and ensures that sufficient moisture is available to hydrate the concrete so that it cures properly.

Surprisingly remarkable results have been achieved using the invention. It has been found that the concrete lining is extremely smooth, uniform and quite hard immediately after removing the pipe section from the apparatus. In part, this is due to the rather high rotational speed to which the pipe is subjected during lining, which speed is substantially greater than the rotational speeds possible with conventional apparatus of the type previously described which employs rollers engaging the peripheral surface of the pipe. As a result, substantially higher centrifugal forces are applied to the concrete, which causes the heavier particles in the concrete to be centrifuged toward the pipe wall and brings the finer particles, such as cement, to the inside of the lining. This causes better compaction of the concrete and produces a lining having a smooth surface. In addition, a larger percentage of the water content of the concrete is removed through centrifuge action. (Upon being released from the spindles, the water, which is collected in the bottom of the pipe, runs out onto the floor.) As a result, the concrete lining formed is dense, hard, and quite compact. Thus, it is not as fragile as the linings produced by conventional lining apparatus. Accordingly, the pipe may be immediately handled without the same degree of care which would ordinarily be required to prevent damage to the uncured lining.

Figure 2:
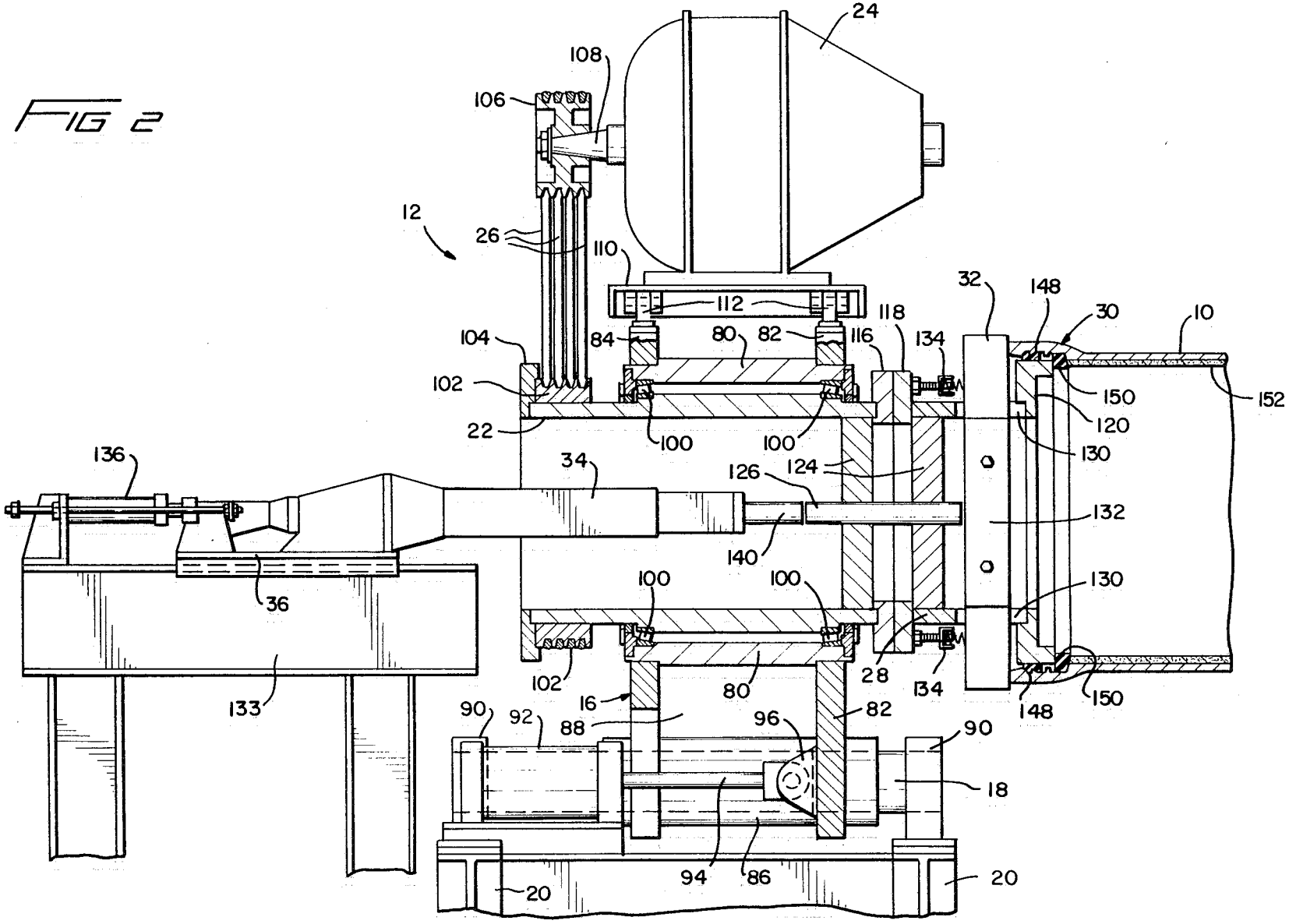
FIG. 2 is a longitudinal cross sectional view of a drive spindle arrangement of the apparatus of FIG. 1.
Figure 3:
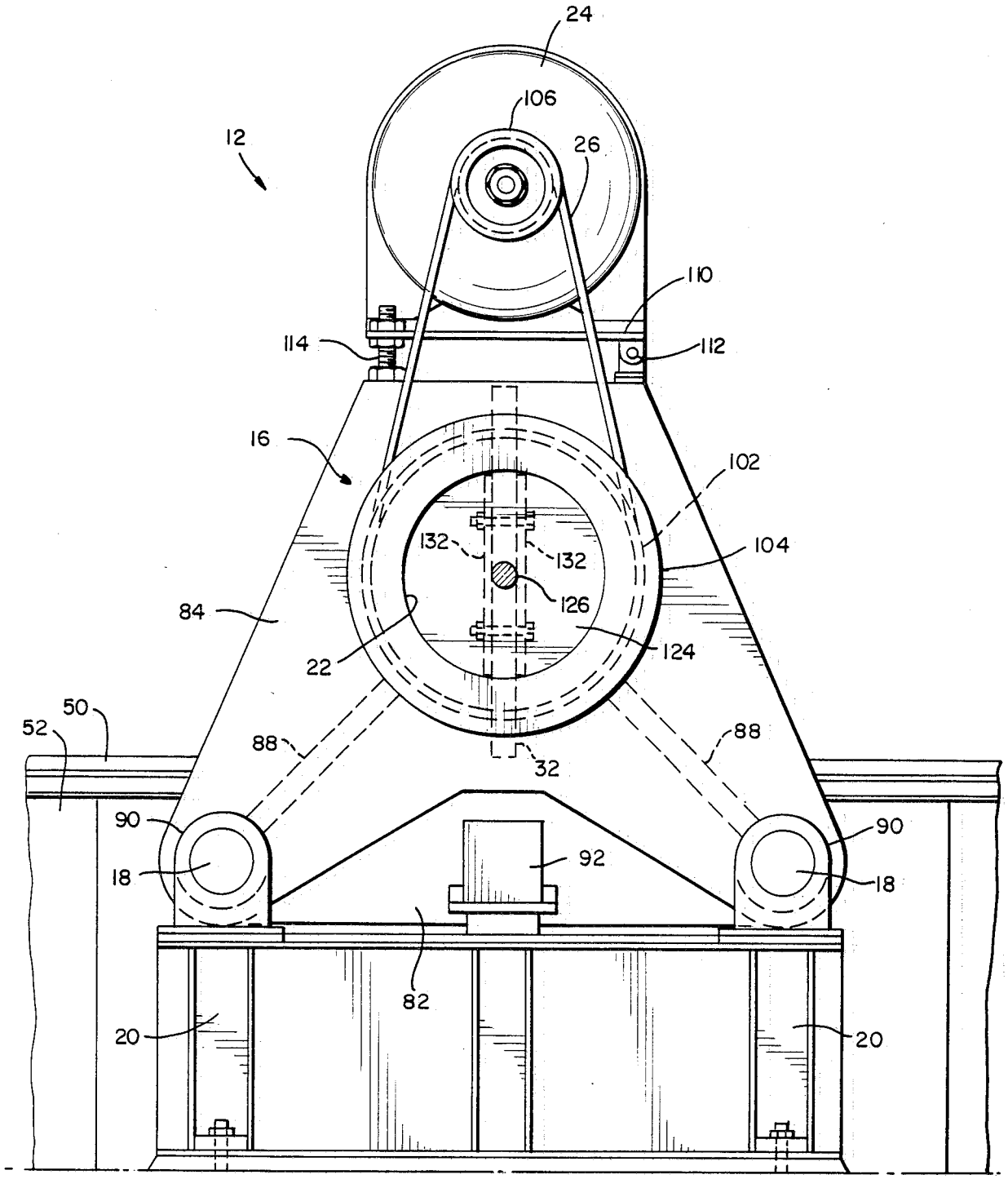
FIG. 3 is an end elevational view of the drive spindle arrangement of FIG. 2 with certain components removed.

FIGS. 2 and 3 illustrate the drive spindle arrangement of the invention in more detail. As shown, the drive spindle frame 16 may comprise a central hollow cylindrical member 80 connected to a pair of somewhat triangularly shaped (see FIG. 3) transversely extending front and rear brackets 82 and 84, respectively. The lower ends of the front and rear brackets may be connected together by cylinders 86 slidingly disposed on guide shafts 18, and support plates 88 may extend between the brackets and between the cylindrical member 80 and cylinder 86. As best shown in FIG. 2, guide shafts 18 may be supported at their front and rear ends by pillow blocks 90 mounted on supports 20. A linear actuator 92 may be mounted on one support, e.g., the rear support, and may have its movable shaft 94 coupled to an ear 96 attached to the lower end of front bracket 82 of the spindle frame. Actuator 92, which may be either a hydraulic, a pneumatic, or an electric actuator, for example, serves to translate the spindle frame axially back and forth on guide shafts 18 to enable the drive spindle to engage and disengage the bell end of the pipe.

As is further shown in FIG. 2, drive spindle 22 may also comprise a hollow cylindrical member which is rotatably supported within cylindrical member 80 of the spindle frame by tapered roller bearings 100. To enable the drive spindle to be rotated by motor 24, a multiple groove sheave 102 may be disposed about the external peripheral surface of the spindle 22 adjacent to a rear end plate 104 and connected by a plurality of V-belts 26 to a mulitiple groove tapered bore sheave 106 located on the motor shaft 108. Motor 24 is mounted on a base 110, one side of which may be pivotally connected at 112 to the tops of spindle brackets 82 and 84 and the other side of which may be connected to the spindle brackets by an adjustment mechanism 114 (see FIG. 3), which may comprise a bolt and nut arrangement, to enable adjustment of the tension in the V-belts. Spindle extension 28, which may be connected to a front end plate 116 of the drive spindle, may be a tubular member having a rear flange 118 (for connection to end plate 116) and an annular dish-shaped front piece 120 sized to fit within and support the bell end 30 of the pipe, as shown in FIG. 2.

The drive spindle and the spindle extension may have disposed within their interiors transversely extending circular plates 124 which slidingly support a coaxially disposed striker rod 126 that is adapted to engage striker member 32. The striker member, which may comprise an elongated rectangular bar, as shown, may extend radially across the inner diameter of the spindle extension and through a pair of diametrically opposed longitudinally extending slots 130 in the wall of the spindle extension. The striker member is selected to have a length sufficient to enable it to extend beyond the external surface of the spindle extension and to engage the end of the pipe, and it may be held within slots 130 during rotation of the spindle by a pair of plates 132 having a length corresponding to the inner diameter of the spindle extension which are bolted on opposite sides of the striker member, as best shown in FIG. 3. The striker member may also be biased toward engagement with the end of the pipe by adjustable spring assemblies 134 located between the striker member and flange 118 of the spindle extension. Spring assemblies 134 also serve to absorb recoil forces on the striker member during longitudinal vibration of the pipe.

As previously noted, striker member 32 is driven by ram 34. As shown in FIG. 2, slide carriage 36 may be mounted on a support 133 which is formed to enable the ram to be inserted coaxially into the rear end of the drive spindle and to engage striker rod 126. The ram may be moved in and out of the drive spindle by a positioning mechanism 136, which may comprise a hydraulic cylinder, for example, connected between support 133 and the slide carriage. Ram 34, which may be similar to a standard concrete breaker, is preferably hydraulically operated and may be, for example, a Kent model KHB-302 hydraulic ram capable of delivering 1200 blows per minute at a force of 410 ft-lbs. per blow. When the ram is moved into engagement with striker rod 126 and actuated, ram rod 140 of the ram reciprocates axially at 1200 cycles per minute, causing striker member 32 (via the intermediate striker rod 126) to strike repetitively the bell end of the pipe and impart a high amplitude axial vibration to the pipe. It has been found that the frequency is not as important as the amplitude of the vibration in producing good compaction of the concrete. The amplitude of the vibration imparted to the pipe is a function of the impact force per blow of the ram, which can be controlled somewhat by controlling the hydraulic fluid pressure supplied to the ram. In general, better results are obtained with higher amplitudes. Striker member 32 and striker rod 126 rotate with the drive spindle. However, the ram does not.

Figures 4, 5:
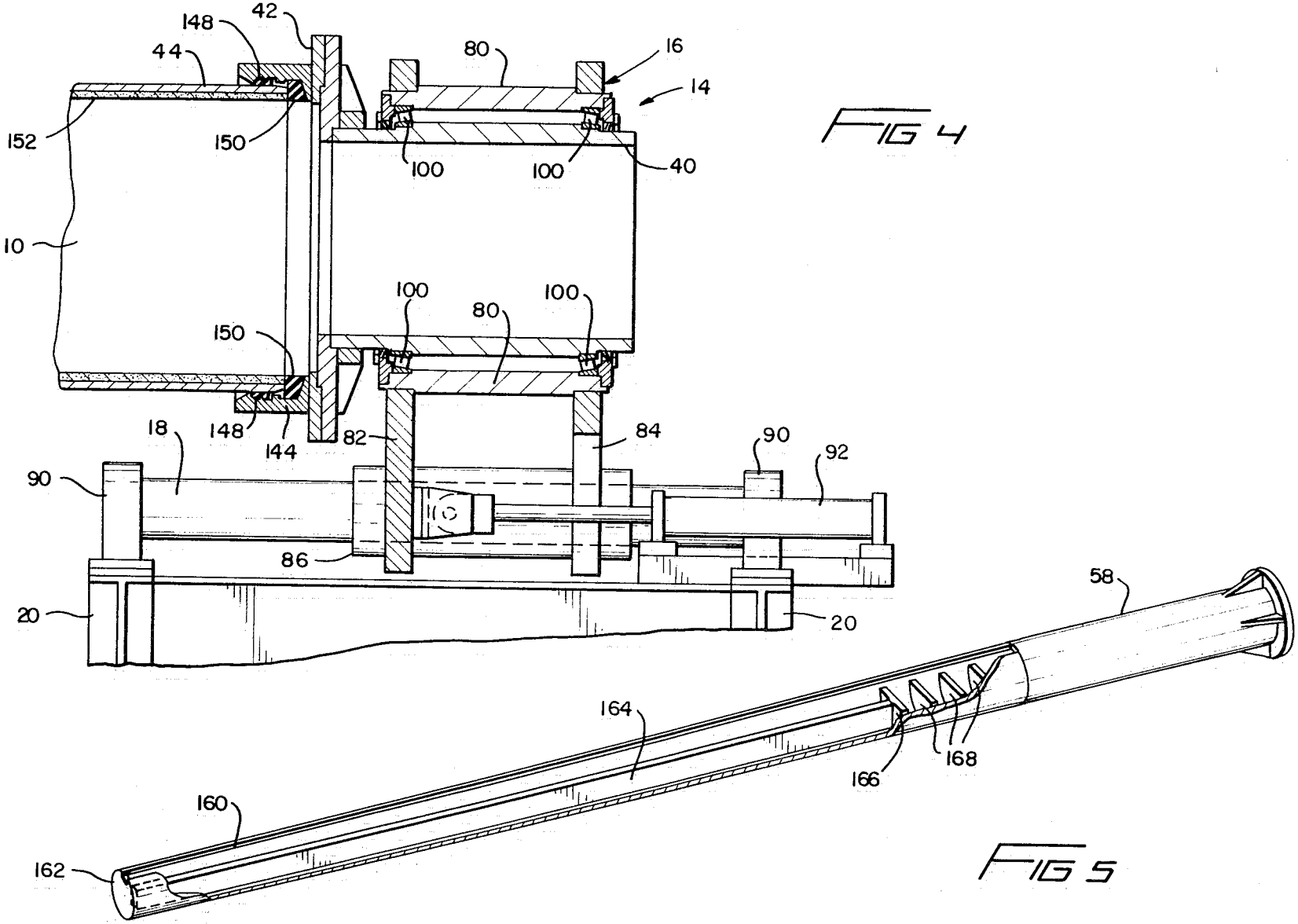
FIG. 4 is a longitudinal cross sectional view of a tail spindle arrangement of the apparatus of FIG. 1.
FIG. 5 is a perspective view, partially broken away, of a trough of the apparatus of FIG. 1 for applying lining material within the interior of the pipe.

The tail spindle arrangement may be generally similar to the drive spindle arrangement, as shown in FIG. 4 wherein the same reference numerals are used to designate elements which are similar to the drive spindle arrangement. The tail spindle arrangement may comprise a hollow cylindrical member 40 rotatably supported by tapered roller bearings 100 within a tubular cylindrical member 80 of the tail spindle frame 16. The spindle frame may be moved axially back and forth on guide shafts 18 by a similar frame translation mechanism 92 as employed for the drive spindle frame. The tail spindle differs from the drive spindle in that it is not formed to enable it to be driven, but simply to rotate freely in the spindle frame. Spindle end plate 42 comprises a cup-shaped annular end piece 144 which is formed to receive the tail end 44 of the pipe and to simulate the internal configuration of the bell end of the pipe.

Referring to FIG. 2, the internal surface of the bell end of standard pipe of the type with which the invention is employed may include circular grooves for receiving resilient gaskets, as of rubber, for sealing the connection between adjacent pipe sections. As shown in FIG. 4, a first annular gasket 148 may be disposed within a groove in the annular end piece 144 of the tail spindle so as to engage the external peripheral surface of the tail end 44 of the pipe section 10 received within the end piece, and a second annular gasket 150 may be positioned within the end piece so as to engage the circular end wall of the tail end of the pipe section. Similar gaskets 148 and 150 are preferably positioned within the bell end 30 of the pipe which is to be lined, as shown in FIG. 2. These gaskets resiliently support the pipe on the drive and tail spindles, particularly in the longitudinal direction, and assist in reducing the vibrational forces imparted to the spindles during lining. Gaskets 150, which as shown in FIGS. 2 and 4 have an inner diameter which is smaller than the inner diameter of the pipe, also conveniently serve as end stops for the concrete lining 152 deposited within the pipe and help ensure that the ends of the lining are straight and uniform.

Referring to FIGS. 1 and 5, trough 58 which is employed for depositing concrete lining material into the interior of the pipe may comprise an elongated tubular member having a longitudinal slot 160 therein which extends from the free end 162 of the trough toward its rear end (the end adjacent to trough car 60) for a distance corresponding to the length of the pipe section to be lined. As best illustrated in FIG. 1, the walls of the tubular trough preferably taper so that the wall thickness decreases from the rear of the trough toward its free end. This reduces the weight of the trough and increases its strength so that vertical deflection is minimized when the trough is charged with concrete lining material. To assist in uniformly distributing the concrete lining material along the length of the trough, an elongated upright baffle plate 164 may be disposed within the trough, as shown. The baffle plate, which extends longitudinally from the free end of the trough to a first transverse baffle plate 166, may be selected to have a height corresponding to the level of the predetermined quantity of concrete required to give a desired lining thickness, and the top of the baffle plate may be used as a reference level for charging the trough with the predetermined quantity of concrete and for ensuring that the concrete is uniformly distributed along the length of the trough.

To enable the trough to be employed for lining different lengths of pipe, additional transversely extending baffles 168 spaced uniformly a predetermined distance apart may also be disposed within the trough. Baffle 166 may be located 18 feet, for example, from the free end of the trough, which corresponds to a standard pipe length, and baffles 168 may be spaced at six inch intervals, for example, up to 20 feet, which corresponds to another standard length. Depending upon the length of pipe being lined, the appropriate number of compartments between the baffles may be filled with concrete. Of course, the amount of concrete with which the trough is charged may also be metered to ensure that the desired predetermined quantity of concrete is used. The required quantity can readily be calculated from the dimensions of the pipe and the thickness of the lining to be formed.

The operation of the invention has been described previously. There are several factors which are responsible for the remarkable results achieved by the invention. These include the high rotational speeds and the axial vibrations imparted to the pipe during lining, which result in better compaction of the concrete and, accordingly, a denser, harder and smoother lining. Although high speed rotation and vibration of the pipe will produce satisfactory linings, the quality of the lining produced is also influenced by the concrete mixture employed. It has been found that significant advantages accrue by employing a concrete mixture which comprises gap-graded sand, i.e., sand composed of particles or grains having sizes which lie in a small number of distinctly different size ranges, such as coarse and fine particles. The centrifugal forces imparted to the concrete mixture during rotation of the pipe cause the heavier components of the mixture to be centrifuged against the pipe wall, and allow the lighter components of the mixture, such as cement and water, to move toward the inside of the pipe lining. With gap-graded sand, the axial vibrations imparted to the pipe during high speed rotation cause the sand particles to fall over each other and allow the fine particles to fill the interstices between the coarse particles. This forces additional water and cement out of the concrete mixture, and produces a smoother, more densely compacted lining.

Another advantage of using gap-graded sand is that less water and cement are required in the mixture. With gap-graded sand, the percentage of voids between sand particles is smaller, and less cement and water is required to fill these voids. Moreover, a desired fluidity can be obtained with less water. It is necessary that the concrete mixture initially deposited within the pipe be sufficiently fluid, i.e., flowable, so that it spreads uniformly over the interior of the pipe prior to high speed rotation. A preferred concrete mixture which has been used quite successfully in the invention comprises gap-graded sand which is composed of approximately equal quantities of only coarse and fine particles, the ratio of the diameters of which is of the order of 8:1, a sand to cement ratio of the order of 3.5–4:1 with a ratio of 3.65:1 being preferred, and a moisture content of the order of 12%. The initial rotational speed of the pipe when the concrete mixture is introduced is of the order of 10–15 G's, as previously noted, with 15 G's being preferred. At these speeds, some compaction of the concrete is produced when it is deposited into the pipe, but the speeds are also low enough to allow the concrete to spread uniformly over the interior surfaces of the pipe and to settle with good knitting of the components of the concrete. Because of the rather fluid nature of the concrete mixture, at speeds less than approximately 5 G's the mixture does not stay on the pipe wall very well. At speeds greater than approximately 20 G's, the mixture does not spread as uniformly nor as smoothly as at lower speeds, and 15 G's has been found to produce consistently good results.

It has likewise been found that high speed rotation sufficient to produce a force of the order of 35–50 G's produces very good compaction of the concrete and results in a smooth, tough lining. The amount of time at which the pipe is rotated at high speed and vibrated has not been found to be particularly critical and may be of the order of 30–60 seconds, for example, with 45 seconds being preferred.

The foregoing operating parameters were derived by employing the invention to apply $\frac{3}{8}$ inch thick concrete linings to 1,000 mm, 20 foot long sections of pipe, and these parameters may vary to some extent depending upon pipe size.

The G-force applied to the lining is related to the rotational speed in RPM and pipe diameter in inches according to the following relationship.

$$(\text{Pipe RPM})^2 \times \text{Diameter} = 70400 \times \text{G's}$$

For lining 1000 mm pipe the drive spindle may have an outer diameter (OD) of the order of 32 inches, sheave 102 may have an OD of the order of 36 inches, and sheave 106 on the motor may have an OD of the order of 14 inches. Motor 24 may be a 100 HP DC motor rated at 1150 RPM, 230 VDC, 356 A full load. This produces a maximum drive spindle rotational speed of the order of 447 RPM, which for 1000 mm pipe corresponds to a maximum G-force of the order of 117 G's. The lathe-like spindle rotating apparatus of the invention securely holds the pipe and rotates it about its longitudinal axis, and out-of-roundess of the pipe does not substantially limit the rotational speeds attainable with the apparatus.

As will be appreciated from the foregoing, the invention provides a highly advantageous method and apparatus for applying concrete linings to pipe. It is readily adaptable to lining pipe of different diameters from about 18 inches to 72 inches, for example, as well as to pipe of different lengths. In fact, different diameter pipe may be readily accomodated simply by appropriately changing the drive spindle extension 28 and the tail spindle end plate 42. Using the apparatus of the invention, a concrete lining may be applied to pipe in a matter of two to three minutes.

While a preferred embodiment of the invention has been shown and described, it will be appreciated by those skilled in the art that changes may be made in this embodiment without departing from the principles and spirit of the invention, the scope of which is defined in the appended claims.

We claim:

1. A method of lining pipe comprising rotating a length of pipe at a first speed about its longitudinal axis while depositing within the interior of the pipe uniformly along the length of pipe a predetermined quantity of lining material, the first speed being selected to spread the lining material evenly about the interior surface of the pipe; increased the rotational speed of the pipe to a second speed substantially higher than the first speed; and repetitively striking one end of the pipe for a predetermined period of time to impart vibrations to the pipe in a direction parallel to its longitudinal axis while simultaneously rotating the pipe at the second speed so as to compact said lining material.

2. The method of claim 1, wherein said depositing comprises inserting axially into one end of the pipe a trough carrying said predetermined quantity of lining material, the lining material being distributed within the trough over a length of the trough corresponding to the length of the pipe, and slowly rotating the trough about its longitudinal axis so as to dump the lining material into the interior of the pipe.

3. The method of claim 2 further comprising removing the trough completely from the interior of the pipe prior to increasing the rotational speed of the pipe to said second speed.

4. The method of claim 1, wherein said rotating comprises engaging the ends of the pipe with a mechanism formed to support the pipe and to rotate about an axis corresponding to the longitudinal axis of the pipe; and the method further comprising resiliently supporting the ends of the pipe in said mechanism.

5. The method of claim 1, wherein the first speed is selected to provide a force of the order of 10–15 G's, and the second speed is selected to provide a force of the order of 35–50 G's.

6. The method of claim 1, wherein said vibrations comprise high amplitude vibrations.

7. The method of claim 1, wherein said lining material is a concrete mixture comprising gap-graded sand.

8. The method of claim 7, wherein the sand comprises substantially equal quantities of coarse and fine particles, the diameters of which have a ratio of the order of 8:1.

9. The method of claim 7, wherein said concrete mixture has a sand to cement ratio of the order of 3.5–4.0, and has a moisture content of the order of 12%.

10. The method of claim 7 further comprising steam curing the concrete lining.

11. The method of claim 1, wherein the predetermined period of time at which the pipe is rotated at the second speed is of the order of 30–60 seconds, and the method further comprises thereafter gradually reducing the speed of the pipe to rest.

12. Apparatus for lining pipe comprising first and second spindle means movable into engagement with the ends of a length of pipe to be lined for supporting the pipe therebetween; means for rotating the spindle means at first and second speeds about an axis corresponding to the longitudinal axis of the pipe, the second speed being substantially higher than the first speed; means for depositing within the interior of the pipe uniformly along the length of the pipe, while the pipe is being rotated at the first speed, a predetermined quantity of lining material, the first speed being selected so as to spread the lining material evenly about the interior surface of the pipe; and means for repetitively striking one end of the pipe to impart vibrations to the pipe in a direction parallel to the longitudinal axis of the pipe while the pipe is being rotated at the second speed so as to compact said lining material.

13. The apparatus of claim 12, wherein said spindle means include means for supporting the pipe resiliently in the longitudinal direction.

14. The apparatus of claim 13, wherein said first and second spindle means comprise, respectively, a drive spindle formed to enter a bell end of the pipe and a tail spindle formed to receive an opposite end of the pipe, and wherein said resilient means comprises resilient members disposed between the spindles and the ends of the pipe.

15. The apparatus of claim 12 further comprising means for moving the drive and tail spindles axially into engagement with the ends of the pipe.

16. The apparatus of claim 14, wherein said striking means comprises a striker member supported on the drive spindle and movable in an axial direction into engagement with the bell end of the pipe, and means for imparting repetitively to the striker member a force so as to cause the striker member to strike the bell end of the pipe.

17. The apparatus of claim 16, wherein the imparting means comprises a striker rod carried coaxially by the drive spindle so as to engage the striker member, and an automatic ram carried on a movable slide carriage so as to enable the ram to strike the striker rod.

18. The apparatus of claim 16, wherein the striker member comprises a bar extending radially across the drive spindle and through diametrically opposed axially extending slots in the drive spindle, and means for biasing the bar into engagement with the bell end of the pipe.

19. The apparatus of claim 12 wherein said depositing means comprises a trough movable axially into one end of the pipe, the trough being formed to carry said predetermined quantity of lining material spread uniformly along a length of the trough corresponding to the length of the pipe.

20. The apparatus of claim 19, wherein the trough is cantilevered with respect to a movable car so as to enable the trough to be inserted axially into the interior of the pipe by movement of the car, the trough being supported on the car by means enabling the trough to be rotated about its longitudinal axis so as to dump lining material into the interior of the pipe.

21. The apparatus of claim 20, wherein the trough has walls of tapering thickness with the thickness of the walls decreasing towards a free end of the trough so as to minimize vertical deflection of the trough.

22. The apparatus of claim 21, wherein the trough includes an axially extending baffle disposed in a bottom of the trough and having a height which corresponds to the level within the trough of said predetermined quantity of lining material.

23. The apparatus of claim 21, wherein the trough includes a series of transversely extending baffles located at predetermined distances from a free end of the trough which correspond to different lengths of pipe to be lined.

24. The apparatus of claim 12, wherein the lining material is a concrete mixture comprising gap-graded sand composed of fine and coarse particles.

25. The apparatus of claim 24, wherein the diameters of the coarse and fine particles have a ratio of the order of 8:1.

* * * * *

UNITED STATES PATENT AND TRADEMARK OFFICE

CERTIFICATE OF CORRECTION

PATENT NO. : 4,597,995

DATED : July 1, 1986

INVENTOR(S) : Snow et al

It is certified that error appears in the above-identified patent and that said Letters Patent is hereby corrected as shown below:

Col. 9, Line 42 change "increased" to --increasing--.
Col. 10, Line 48 [claim 12] should read --claim 14--.
Col. 11, Line 1 after "claim 12" add a comma.

Signed and Sealed this

Seventh Day of October, 1986

[SEAL]

*Attest:*

DONALD J. QUIGG

*Attesting Officer*

*Commissioner of Patents and Trademarks*